United States Patent [19]

Bachrach

[11] Patent Number: 4,807,652

[45] Date of Patent: Feb. 28, 1989

[54] COMB

[75] Inventor: Frank Bachrach, Great Neck, N.Y.

[73] Assignee: American Comb Corp., Paterson, N.J.

[21] Appl. No.: 95,929

[22] Filed: Sep. 14, 1987

[51] Int. Cl.[4] ..... A45D 24/04

[52] U.S. Cl. ..... 132/137; 15/159 A; 15/187; 132/142; 132/157; 132/159; 132/212

[58] Field of Search ..... 132/11 R, 158, 159, 132/160, 161, 137, 139, 125, 148, 142, 163, 152, 153, 157; 15/159 A, 186, 187, 188

[56] References Cited

U.S. PATENT DOCUMENTS

| | | | |
|---|---|---|---|
| 1,305,226 | 5/1919 | Kunkler | 132/11 R |
| 4,345,608 | 8/1982 | Cavaioli et al. | 132/11 R X |
| 4,612,945 | 9/1986 | Bachrach | 132/137 |

*Primary Examiner*—Gene Mancene
*Assistant Examiner*—Adriene J. Lepiane
*Attorney, Agent, or Firm*—Arthur Dresner

[57] ABSTRACT

A comb for removing lice and nits from the hair is formed by a base and a plurality of teeth extending from the base in substantially the same direction. The longitudinal axis of each tooth is parallel to the longitudinal axis of each other tooth. Each tooth has a polygonal cross sectional shape such as in the form of a modified triangle. The cross sectional dimensions of each tooth enlarge from the free end of each tooth toward the base so that the spacing between adjacent teeth narrows toward the base. The facing edges of adjacent teeth interact with each other to capture lice and nits therebetween. A rib is provided longitudinally along one of the faces of each tooth.

8 Claims, 2 Drawing Sheets

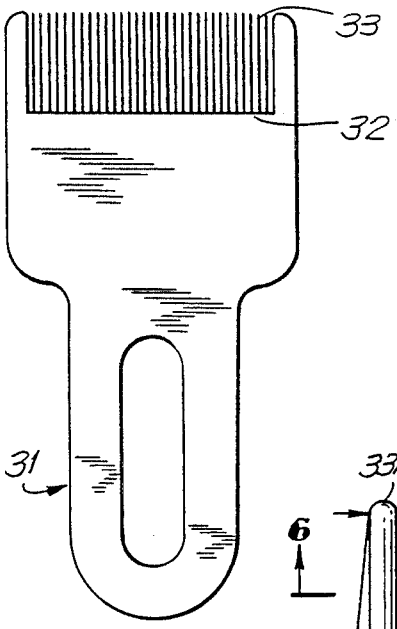
FIG. 1
FIG. 2
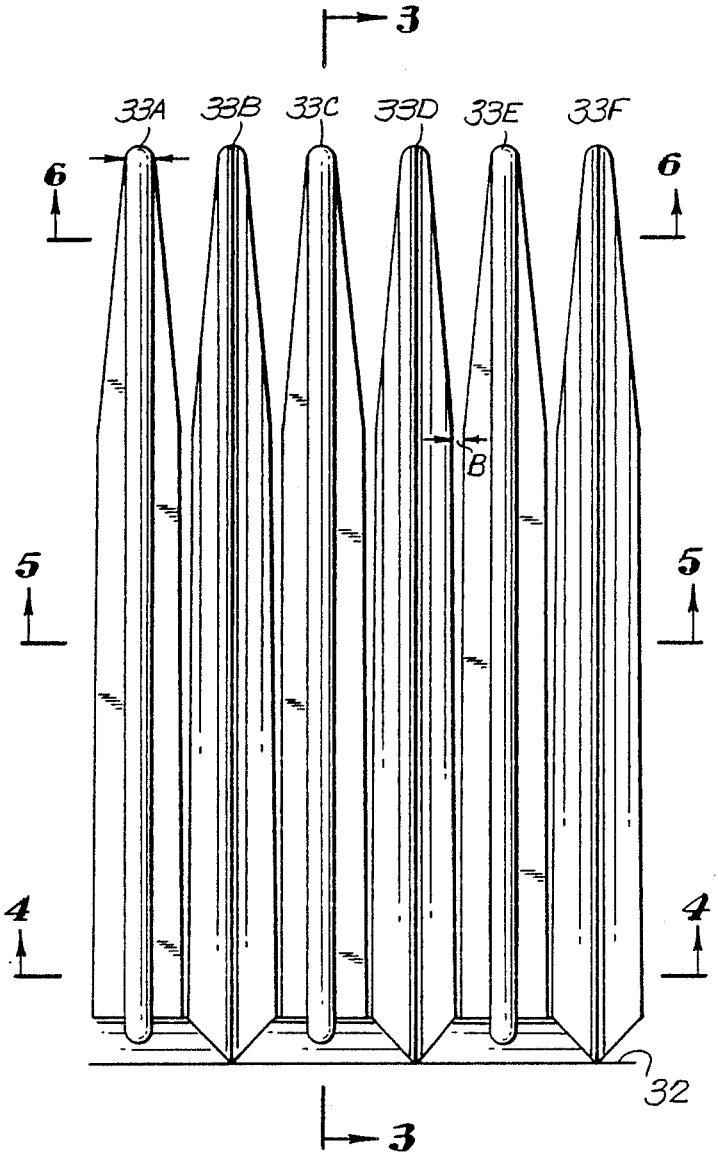

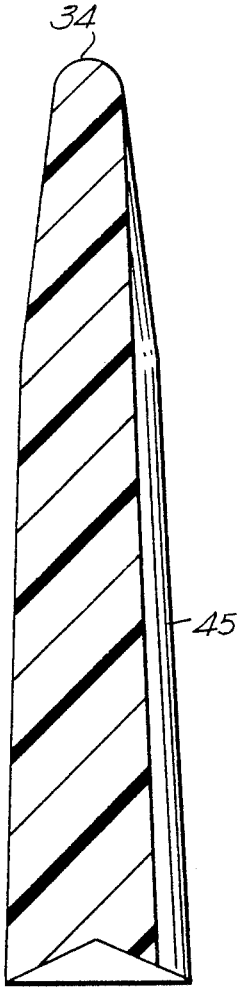
FIG. 3
FIG. 6
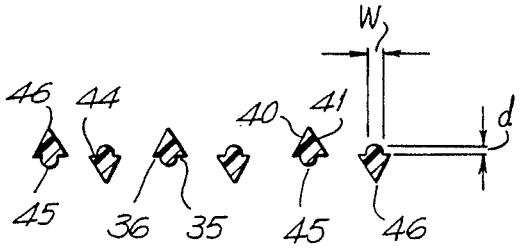
FIG. 5
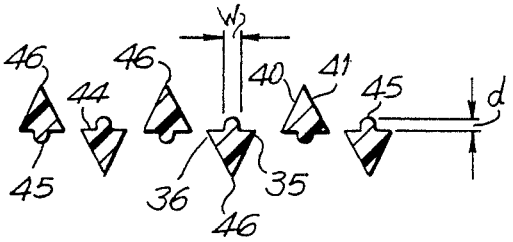
FIG. 4
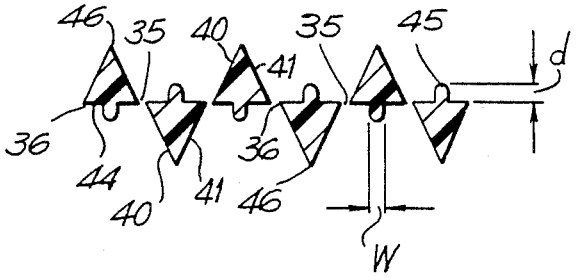

COMB

FIELD OF THE INVENTION

The present invention relates generally to the field of combs and more particularly to a comb having uniquely designed teeth particularly useful for removing lice and nits from hair.

BACKGROUND OF THE INVENTION

Heretofore lice combs have been formed simply by spacing adjacent teeth very close together so that lice or nits would be caught in the narrow space between adjacent teeth. The design of the teeth of such lice combs have typically been no different than the designs of teeth of any other styling type comb having a cross sectional shape which has traditionally been oval or sometimes rectangular. While this type of lice comb has been somewhat effective, there has always been the danger of not being able to remove all of the unhatched eggs or all of the hatched eggs of lice from the hair as a result of the eggs slipping through the comb in the space between adjacent teeth since such teeth typically have flat or slightly curved opposing faces.

Recent attempts at overcoming the disadvantages of the prior lice comb designs have involved creating teeth with portions that overlap into the spacing between adjacent teeth so as to further narrow this spacing. The result has been combs having teeth with complicated cross sectional shapes thus making the creation of molds for producing plastic combs complicated and expensive. In addition, such design tends to render the teeth susceptible to easy breaking.

An improvement over the prior designs have been the combs shown and described in prior U.S. Pat. Nos. 4,612,944 and 4,612,945. However, the comb provided by the present invention is yet a further improvement.

It is accordingly a principal object of the present invention to provide a comb useful for removing lice and nits from hair which generally overcomes the disadvantages of the prior art.

A more specific object of the present invention is to provide such a comb having teeth which are generally triangular in cross sectional shape in which the cross sectional dimensions of such teeth enlarge toward the base of the comb so that spacing between facing edges of adjacent teeth continually narrows to assure catching all lice and nits.

Yet a further object of the present invention is to provide a comb having teeth with interacting adjacent facing edges which serve to capture lice and nits, and which are provided with a supporting rib.

Other objects, features and advantages of the present invention will become more apparent from the detailed description of the invention in conjunction with the accompanying drawings to be described more fully hereinafter.

SUMMARY OF THE INVENTION

The foregoing objects of the present invention are generally accomplished by providing a comb for removing lice and nits from the hair formed by a base and plurality of teeth extending from the base in substantially the same direction with the longitudinal axis of each tooth being parallel to the longitudinal axis of each other tooth. Each of the teeth has a substantially triangular cross sectional shape and a rib longitudinally arranged along one of the faces of each tooth.

The cross sectional dimensions of each tooth enlarge from the free end of each tooth toward the base so that the spacing between adjacent teeth narrows toward the base. The edges of adjacent teeth thus interact to capture lice and nits.

BRIEF DESCRIPTION OF THE DRAWINGS

The foregoing and other features of the present invention are more fully described with reference to the following drawings annexed hereto, in which:

FIG. 1 is a front elevational view illustrating one form of a comb incorporating one embodiment of the present invention;

FIG. 2 is an enlarged front elevational view showing in detail some of the teeth of the embodiment of FIG. 1;

FIG. 3 is a sectional view taken along lines 3—3 of FIG. 2;

FIG. 4 is a sectional view taken along lines 4—4 of FIG. 2;

FIG. 5 is a sectional view taken along lines 5—5 of FIG. 2; and

FIG. 6 is a sectional view taken along lines 6—6 of FIG. 2.

DESCRIPTION OF THE INVENTION

FIG. 1 illustrates a comb 31 incorporating the features of one embodiment of the present invention, which is generally formed by a base 32 and a plurality of teeth 33 which extend vertically upward, as illustrated in FIG. 1, away from the base 32. The design of the teeth 33, which renders the present invention particularly effective, is more clearly illustrated in FIGS. 2 through 6. FIG. 2 shows, in an enlarged view, teeth 33A, 33B, 33C, 33D and 33E and 33F extending from base 32 and aligned adjacent to each other. The longitudinal axis of each of these teeth is arranged parallel to each other.

From FIGS. 2 and 3, it will also be noted that the top 34 of each of the teeth 33 is rounded in order to avoid any injury to the user.

FIGS. 4–6 illustrate that the cross sectional shape of the teeth shown in this embodiment is substantially triangular, each having side surfaces 40 and 41, bottom surface 44 and a rib 45 extending longitudinally along the bottom surface 44. As can be appreciated from the cross sectional views of FIGS. 4–6, the rib 45 extends the full length of the tooth. The width W of each rib remains constant throughout the length of the tooth (preferably having a dimension of about 0.022 inches). The depth of each rib (dimension "d") however, decreases from the base toward the free end. Depending on the overall dimensions of the comb, a preferred size of the rib would be about 0.033 inches at the base to about 0.022 inches at the free end of each tooth. These dimensions might change depending on other dimensions of the comb, but the width of each rib is less than the width of the bottom surface of its tooth. The side surfaces and bottom surfaces decrease in dimension from the base toward the free end. Thus each tooth forms a three sided pyramid having a rib along one side, the base of each pyramid lying in a plane perpendicular to the axis of each tooth, and the surface 44 of each tooth lying in the same plane as the surface 44 of every other tooth throughout its length.

The intersection of side surface 40 with bottom surface 44 forms an edge 36 while the intersection of side surface 41 with bottom surface 44 forms an edge 35. When in use, the facing edges 35 and 36 of the adjacent teeth will begin to come closer to each other toward the base 32, so that the spacing B between adjacent teeth gets smaller to a point where particles of lice or nits will be caught between the interacting edges of adjacent teeth. However, at the base 32 facing edges of adjacent teeth are no closer than the average diameter of a human hair.

When viewed in cross section, the intersection of side surfaces 40 and 41 forms an apex 46. The cross sectional apex 46 of adjacent teeth extend in opposite directions.

As will be appreciated by comparing FIGS. 4–6, the length of each side will continually increase from the top 34 of each tooth toward the base 32.

The bottom surface 44 of each tooth lies along the same line when viewed in cross section taken across the longitudinal axis of each tooth, as is seen in FIGS. 4–6.

Rib 45 of each tooth serves to inhibit the teeth from being bent and interfacing with the desired action of the comb.

While the foregoing invention has been described and illustrated with respect to certain embodiments which provide satisfactory results, it will be appreciated, by those skilled in the art, after understanding the principles of the present invention, that various changes and modifications may be made without departing from the spirit and scope of the present invention, and it is therefore intended to cover all such changes and modifications in the appended claims.

What is claimed is:

1. An improved comb for removing lice and nits from hair having a base, a plurality of teeth extending substantially in the same direction away from the base, the longitudinal axis of each tooth being parallel to the longitudinal axis of each other tooth and substantially the same length, each said tooth having a substantially triangular cross sectional shape forming a three sided pyramid, the sides of each such cross sectional triangle increasing in width from the free end of each tooth toward the base, so that the spacing between adjacent teeth narrows toward said base, the cross sectional triangle of each tooth having a bottom surface and an apex opposite said bottom surface, and side surfaces connecting said apex and bottom surfaces, the bottom surface of each cross sectional triangle of each tooth lying along the same line when the cross sectional plane of one tooth passes through each other tooth, each of the surfaces of said cross sectional shape of each tooth converging at a substantially rounded top of each tooth, wherein the improvement comprises a rib extending longitudinally along said bottom surface of each tooth, the width of said rib being less than the width of the bottom surface of its tooth.

2. The improved comb according to claim 1 wherein the side surfaces and bottom surface of each tooth meet to form an edge at the intersection thereof, said teeth being arranged on said base so that said apex of said cross sectional triangle is directed opposite to that of the apex of the cross sectional triangle of each adjacent tooth.

3. The improved comb according to claim 2 wherein facing edges of adjacent teeth are spaced apart at said base by no less than the average diameter of a human hair.

4. The improved comb according to claim 3 wherein the width of each surface of said cross sectional triangular shape increases from the top of each tooth toward the base so that the distance between facing surfaces of adjacent teeth diminishes from the top of said teeth toward the base.

5. The improved comb according to claim 4 wherein the base of each tooth lies in the same plane.

6. The improved comb according to claim 1 wherein said rib extends substantially the entire length of each said tooth.

7. The improved comb according to claim 6 wherein the width of said rib of each tooth is a constant dimension over the entire length of said rib.

8. The improved comb according to claim 6 wherein the depth of said rib of each tooth decreases from the base of said comb toward the free end of each tooth.

* * * * *